US006227535B1

(12) United States Patent
Bae

(10) Patent No.: US 6,227,535 B1
(45) Date of Patent: May 8, 2001

(54) AUTOMATIC SHEET FEEDER OF A PRINTING MACHINE

(75) Inventor: Sang-Jin Bae, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/568,343

(22) Filed: May 10, 2000

(51) Int. Cl.[7] ..... B65H 3/52
(52) U.S. Cl. ..... 271/121; 271/167
(58) Field of Search ..... 271/121, 167, 271/113, 117, 109

(56) References Cited

U.S. PATENT DOCUMENTS 5,938,190 * 8/1999 Campbell et al. ..... 271/121 X
5,938,355 * 8/1999 Suzuki ..... 271/121 X
5,971,390 * 10/1999 Caspar et al. ..... 271/121

* cited by examiner

*Primary Examiner*—David H. Bollinger

(74) *Attorney, Agent, or Firm*—Robert E. Bushnell, Esq.

(57) ABSTRACT

An automatic sheet feeder of a printing machine feeds paper by a rotational pressing force exerted between a paper friction fed section and a paper feeding roller. The automatic sheet feeder includes an idle pad roller rotated in contact with the paper feeding roller by the rotational pressing force exerted on the paper feeding roller in absence of paper in the paper loading section, and an elastic member for elastically controlling the rotational movement of the idle pad roller in contact with the idle pad roller while the idle pad roller is rotated by the rotational pressing force of the paper feeding roller. Accordingly, even when the paper feeding operation is carried out in the absence of paper in the paper loading section, the frictional load between the paper feeding roller and the paper friction pad is minimized through the rolling friction operation of the idle pad roller. As a result, paper double feeding or slippage caused due to the abrasion of the paper feeding roller is prevented, while the paper feeding operation is efficiently carried out for a long period of time by preventing the faulty feeding of paper. Further, since there is no overload by the high frictional force exerted on the paper feeding roller, the stepping out or abrasion of the components is prevented, and the life span of the printing machine is lengthened, while the resistance and reliability of the product are enhanced.

4 Claims, 5 Drawing Sheets

AUTOMATIC SHEET FEEDER OF A PRINTING MACHINE

BACKGROUND OF THE INVENTION

1. Field of the Invention

The present invention relates to a printing machine, and more particularly, to an automatic sheet feeder of a printing machine having a maximized sheet feeding efficiency and durability by minimizing the frictional load during the feeding operation thus by preventing the occurrence of stepping out and abrasion of respective components or paper double feeding and slippage.

2. Description of the Prior Art

Generally, an automatic sheet feeder (ASF) is an essential part of a printing machine which picks up each sheet of paper and conveys the picked sheet of paper to a printing section.

FIGS. 1 and 2 show one example of such an automatic sheet feeder.

Conventionally, the so-called "compensator type ASF" has been used in which gears 1 driven by a driving motor (not shown) drive a rotational shaft 2, to rotate a compensator 3 disposed on the rotational shaft 2 toward a paper loading section 4. Being rotated toward the paper loading section 4, the compensator 3 comes into contact with the first sheet of paper P loaded in the paper loading section 4, and picks up and feeds the first sheet of paper P through a paper feeding roller 5 which is mounted on an end of the compensator 3 and rotated by the driving force transmitted from the rotational shaft 2.

Here, paper pick up devices in almost all kinds of automatic sheet feeders (inclusive of the above-described automatic sheet feeder) pick up and feed a sheet of paper P by the rotational force of the paper feeding roller 5 in a state that the paper feeding roller 5 is pressed into contact with a paper friction pad 6 which is made of cork material and attached on the bottom of the paper loading section 4.

Since the conventional automatic sheet feeder 10 does not have any means for detecting the presence of the paper P in the paper loading section 4, many problems have been caused by the printing operation started by the printing command in the absence of the paper P in the paper loading section 4.

More specifically, when the printing operation is carried out in the absence of paper P, due to the frictional force generated between the rotating paper friction pad 6 and the paper feeding roller 5, noise is produced between the rotating paper friction pad 6 and the paper feeding roller 5, and finally, faulty sheet feeding operation of the printing machine such as paper double feeding or slippage occurs as the paper feeding roller 5 and the paper friction pad 6, which are capped by a rubber material, are quickly worn out.

Further, the overload caused by the frictional force between the paper feeding roller 5 and the paper friction pad 6 may also cause stepping out of the components such as the motor and gears 1, etc., damaging the printing machine.

The above-mentioned problems shorten the life span of the printing machine, deteriorating the reliability which results in user dissatisfaction.

SUMMARY OF THE INVENTION

The present invention has been developed to overcome the above-mentioned problems of the prior art, and accordingly, it is an object of the present invention to provide an automatic sheet feeder of a printing machine capable of minimizing a friction load between a paper feeding roller and paper friction pad during a feeding operation in the absence of paper, thus keeping the high feeding efficiency for a long period of time by preventing faulty feeding of paper such as paper double feeding and slippage, and thus lengthening the life span of the printing machine by preventing stepping out or abrasion of the components.

In order to accomplish the above-mentioned object, an automatic sheet feeder of a printing machine includes a paper friction pad section and a paper feeding roller for feeding a sheet of paper by a rotational pressing force exerted between the paper friction pad section and the paper feeding roller, and an idle pad roller formed on the paper friction pad section for being rotated in contact with the paper feeding roller by the rotational pressing force exerted on the paper feeding roller in absence of paper in the paper loading section.

The automatic sheet feeder further includes an elastic member formed on the paper friction pad section for elastically controlling the rotational movement of the idle pad roller in contact with the idle pad roller while the idle pad roller is rotated by the rotational pressing force of the paper feeding roller.

The idle pad roller is positioned slightly lower than the bottom surface of the paper loading section in a manner that the rotational shaft thereof is inserted into shaft guides which penetrate in both sides of the paper friction pad section to be elastically supported by the elastic member.

Accordingly, during the feeding operation, the idle pad roller and the paper feeding roller do not make contact in the presence of paper, while the idle pad roller and the paper feeding roller contact with each other in the absence of paper.

The elastic member includes a space formed in the center for receiving the idle pad roller, and a plate spring having a pair of elastic supports formed on both sides of the space and are elastically supported on the rotational shaft at both sides of the idle pad roller.

DETAILED DESCRIPTION OF THE PREFERRED EMBODIMENT

Hereinafter, the preferred embodiment of the present invention will be described in greater detail with reference to the accompanying drawings.

Figure 1:
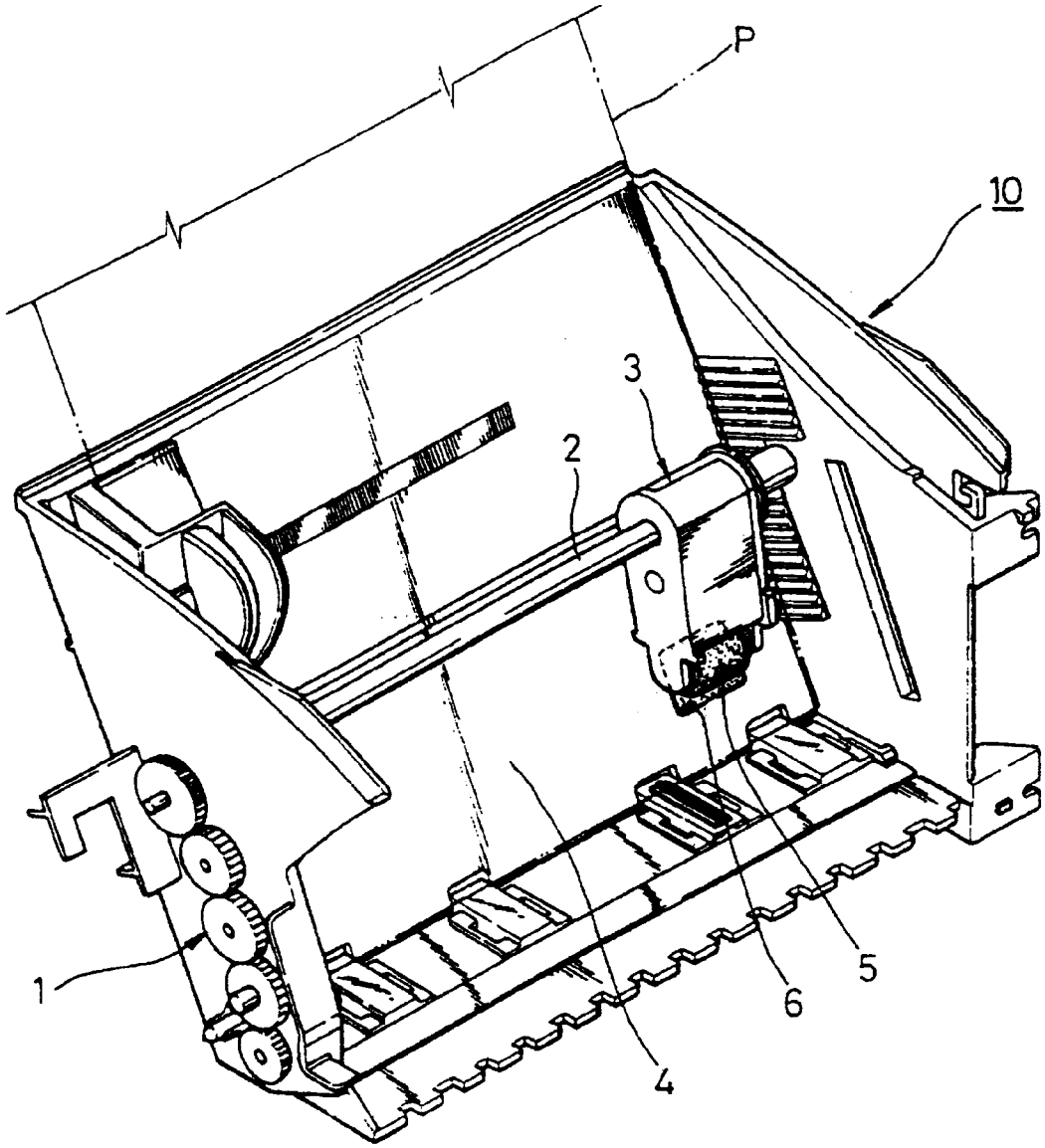
FIG. 1 (PRIOR ART)
FIG. 1 is a perspective view for showing an example of a conventional automatic sheet feeder of a printing machine.
Figure 2:
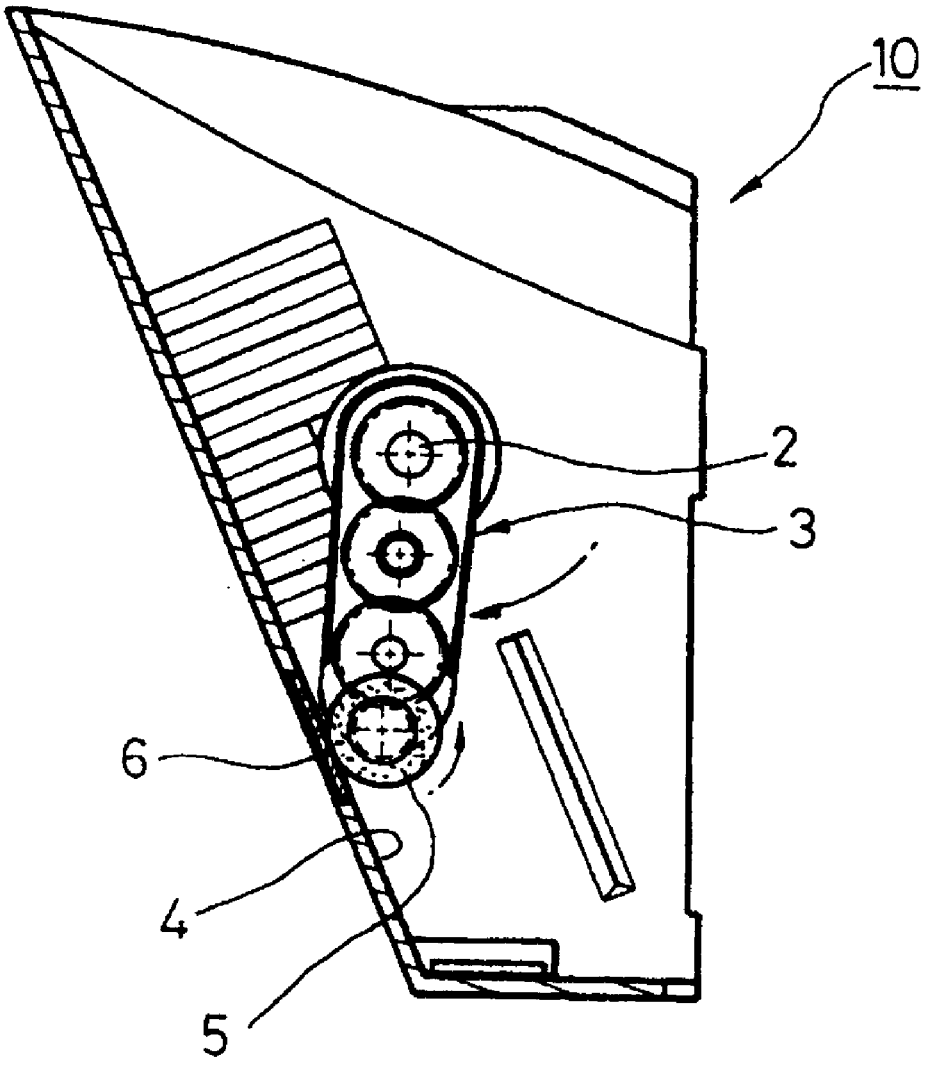
FIG. 2 (PRIOR ART)
FIG. 2 is a side sectional view for schematically showing the problem of the conventional automatic sheet feeder.
Figure 3:
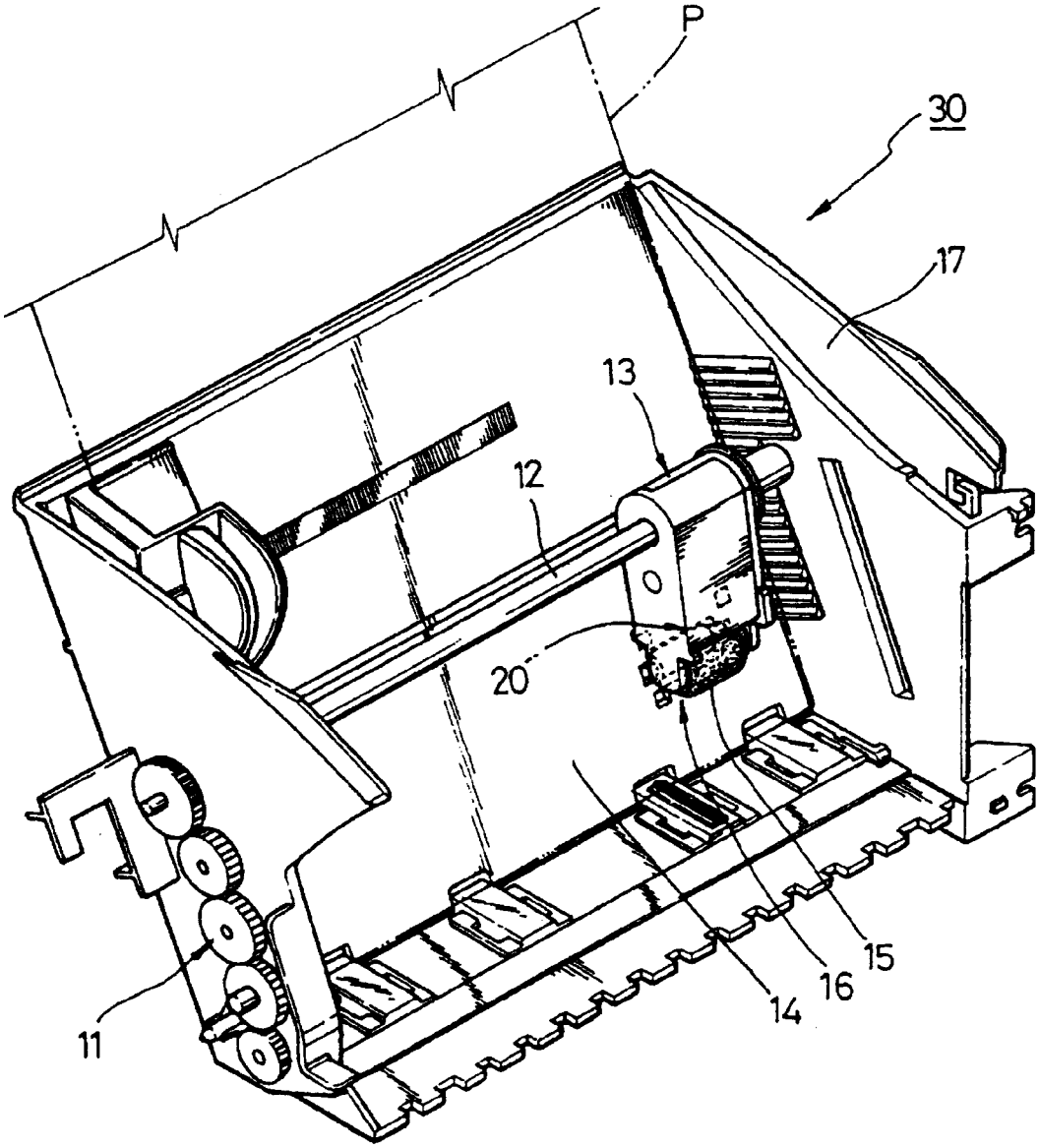
FIG. 3 is a perspective view for showing the construction of an automatic sheet feeder of a printing machine according to the present invention.
Figure 4A:
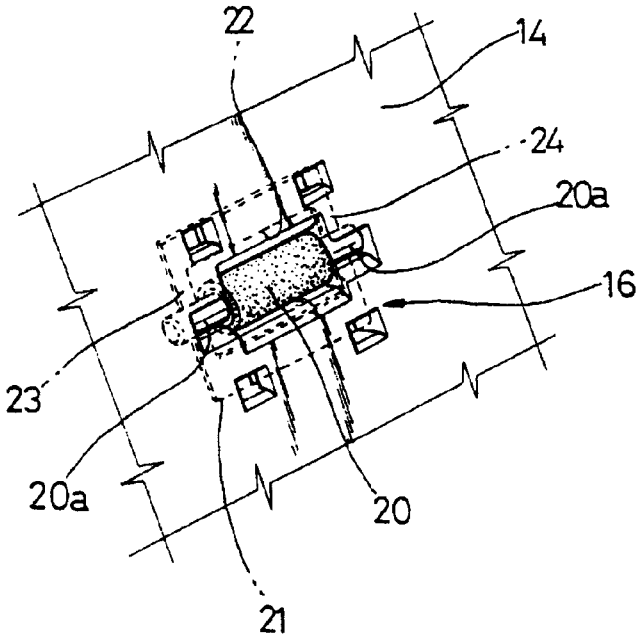
FIGS. 4A and 4B are front and rear perspective views for showing a paper friction pad of an automatic sheet feeder according to the present invention.
Figure 4B:
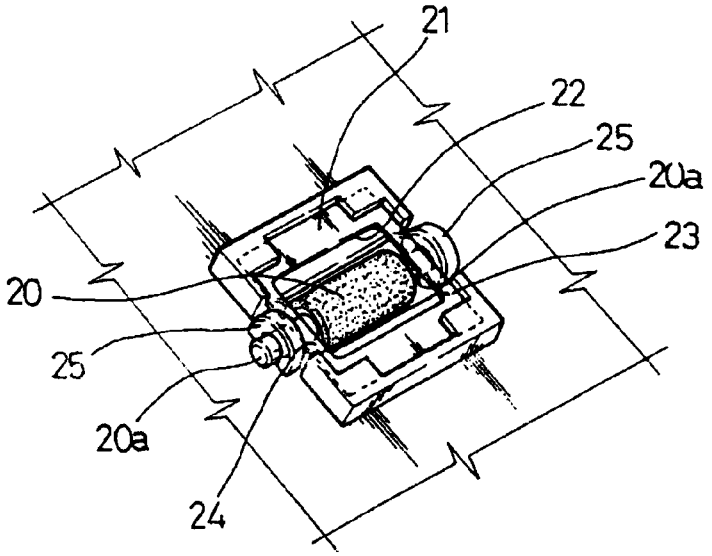

FIG. 3 is a perspective view for showing the construction of the automatic sheet feeder of the printing machine according to the present invention, and FIGS. 4A and 4B are front and rear perspective views for showing a paper friction pad 16 of the automatic sheet feeder according to the present invention.

The compensator type automatic sheet feeder 30 according to the preferred embodiment of the present invention includes gears 11 arranged on the side of a frame 17 and driven by a driving motor (not shown), and a rotational shaft 12 which is connected with the gear 11 and is horizontally disposed with respect to a rear wall of the frame 17. Here, the frame 17 has a paper loading section 14 on which a plurality of paper P is loaded.

A compensator 13 is disposed on the rotational shaft 12, which is rotated toward the paper loading section 14 by the rotational force from the rotational shaft 12, and has a paper feeding roller 15 formed on an end of the compensator 13 and is rotated by the driving force transmitted through the rotational shaft 12.

During the sheet feeding operation, the automatic sheet feeder 30 picks up and feeds a sheet of paper P through the paper friction pad 16 by the pressing force generated by the rotational movement of the compensator 13, and the rotational force of the paper feeding roller 15.

Here, as mentioned earlier, many problems are caused due to paper feeding operation started by the printing command in the absence of the paper P in the paper loading section 14.

The automatic sheet feeder 30 according to the present invention includes an idle pad roller 20 mounted on the paper friction pad 16. Accordingly, in the presence of paper P in the paper loading section 14, the automatic sheet feeder 30 picks up and feeds the sheet of paper P by the rotational pressing force between the sheet of paper P and the paper feeding roller 15, while in the absence of paper in the paper loading section 14, the automatic sheet feeder 30 is rotated in contact with the paper feeding roller 15 only when the paper feeding roller 15 is under the overload of the rotational pressing force exerted thereto.

The idle pad roller 20 substitutes the function of the conventional paper friction pad, and is made of synthetic resin or metal into the shape of a roller. The idle pad roller 20 is capped by a rubber material which has a high frictional abrasion resistance.

Here, it is preferable that the friction coefficient of the rubber of the idle pad roller 20 is lower than the friction coefficient of the paper feeding roller 15, and is higher than the friction coefficient between each sheet of paper P.

Further, an elastic member is provided to elastically control the rotation of the idle pad roller 20 which is rotated by the rotational pressing force of the paper feeding roller 15.

The elastic member is formed of a plate spring 21 which is substantially in the shape of square, and includes a space 22 formed in the center for receiving the idle pad roller 20, and a pair of elastic supports 23 and 24 protruding from both sides of the idle pad roller 20 to be elastically supported on the rotational shaft 20*a*.

Meanwhile, the rotational shaft 20*a* of the idle pad roller 20 is inserted into the shaft guides 25 formed at both sides of the paper friction pad 16, to be elastically supported by the elastic supports 23 and 24 of the plate spring 21. Accordingly, the idle pad roller 20 is positioned slightly lower than the bottom surface 14*a* of the paper loading section 14 during the feeding operation.

In the presence of the paper in the paper loading section 14, a sheet of paper P is picked up and fed while the idle pad roller 20 and the paper feeding roller 15 are not in contact, while in the absence of paper in the paper loading section 14, the paper feeding operation is carried out while the idle pad roller 20 is rotated together with the paper feeding roller 15.

Figure 5A:
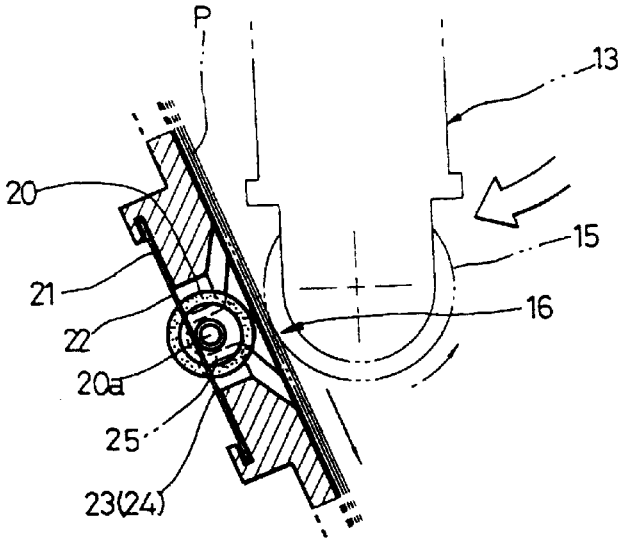
FIGS. 5A and 5B are enlarged sectional view for showing the main portion of the present invention, i.e., for showing the operational status of the paper friction pad of the automatic sheet feeder according to the present invention.
Figure 5B:
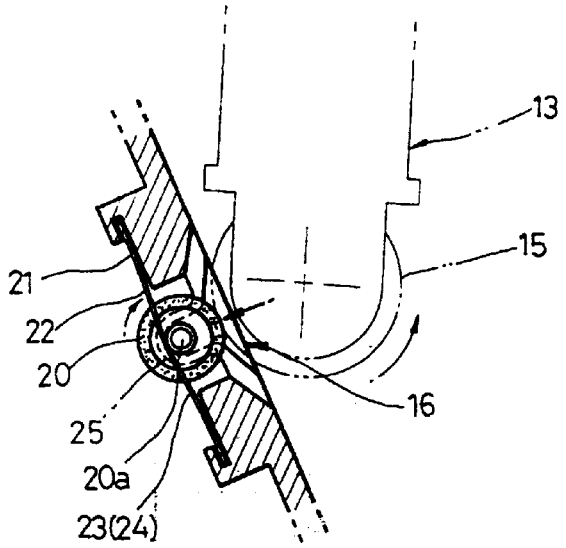

The operation of the present invention constructed as above will be described below with reference to FIGS. 5A and 5B.

In the automatic sheet feeder 30 according to the present invention, upon receipt of the printing command in the presence of paper P in the paper loading section 14, the paper feeding operation begins, i.e., the compensator 13 is driven into tight contact with the paper P while the paper feeding roller 15 is rotated.

At this time, the idle pad roller 20 and the paper P are in tight contact under the pressing force of the paper feeding roller 15.

Here, the frictional force exerted between the idle pad roller 20 and the paper P is greater than the frictional force between each sheet of paper P. Since the frictional force exerted between the paper feeding roller 15 and the sheet of paper P is greater than the frictional force between each sheet of paper P, each sheet of paper P can be sequentially picked up and fed by the rotation of the paper feeding roller 15, while the idle pad roller 20 is not rotated (see FIG. 5A).

Meanwhile, upon receipt of the printing command in the absence of paper P in the paper loading section 14, the paper feeding operation begins, and the compensator 13 is driven into tight contact with the idle pad roller 20, while the paper feeding roller 15 is simultaneously rotated.

At this time, since the rotational shaft 20*a* of the idle pad roller 20 is elastically supported by the elastic supports 23 and 24, as the compensator 13 presses down the idle pad roller 20 against the elasticity of the plate spring 21, the idle pad roller 20 is lowered down within the shaft guides 25.

Then, in the state that the idle pad roller 20 is under both of the pressing force of the compensator 13 and the recovering force of the plate spring 21, the paper feeding roller 15 is rotated by the paper pick up operation under the rotational force greater than the recovering force of the plate spring 21, and accordingly, the idle pad roller 20 which is in contact with the plate spring 21 is rotated together with the paper feeding roller 15, overcoming the recovering force of the plate spring 21.

Accordingly, even when the paper feeding operation is carried out in the absence of paper P in the paper loading section 14, the paper feeding roller 15 is smoothly rotated in contact with the idle pad roller 20 through a rolling friction operation, causing no noise at the paper friction pad 16, or overload by the frictional force, or stepping out of components such as gear, motor, etc.

As described above, in the printing machine according to the present invention, even when the paper feeding operation is carried out in the absence of paper P in the paper loading section 14, the frictional load between the paper feeding roller 15 and the paper friction pad 16 is minimized through the rolling friction operation of the idle pad roller 20. As a result, paper double feeding or slippage caused due to the abrasion of the paper feeding roller 15 is prevented, while the paper feeding operation is efficiently carried out for a long period of time by preventing faulty feeding of paper.

Further, since there is no overload by the high frictional force exerted on the paper feeding roller 15, the stepping out or abrasion of the components is prevented, and the life span of the printing machine is lengthened, while the resistance and reliability of the product are enhanced.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. An automatic sheet feeder of a printing machine comprising: a paper friction pad section and a paper feeding roller for feeding paper by a rotational pressing force exerted between the paper friction pad section and the paper feeding roller; and an idle pad roller formed on the paper friction pad section for being rotated in contact with the paper feeding roller by the rotational pressing force exerted on the paper feeding roller in the absence of paper in the paper loading section.

2. The automatic sheet feeder as claimed in claim 1, further comprising an elastic member formed on the paper friction pad section for elastically controlling the rotational movement of the idle pad roller in contact with the idle pad roller while the idle pad roller is rotated by the rotational pressing force of the paper feeding roller.

3. The automatic sheet feeder as claimed in claim 2, wherein the idle pad roller is positioned slightly lower than the bottom surface of the paper loading section in a manner that a rotational shaft thereof is inserted into shaft guides which penetrate in both sides of the paper friction pad section to be elastically supported by the elastic member.

4. The automatic sheet feeder as claimed in claim 2, wherein the elastic member comprises a space formed in the center for receiving the idle pad roller, and a plate spring having a pair of elastic supports formed on both sides of the space and are elastically supported on the rotational shaft at both sides of the idle pad roller.

* * * * *